United States Patent [19]

Noguchi et al.

[11] Patent Number: 4,586,461

[45] Date of Patent: May 6, 1986

[54] DRY-TYPE DEVELOPING DEVICE FOR ELECTROPHOTOGRAPHY

[75] Inventors: Matsusaburo Noguchi; Mikio Yamamoto; Shinichi Furukawa, all of Tokyo, Japan

[73] Assignee: Oki Electric Industry Co., Ltd., Tokyo, Japan

[21] Appl. No.: 705,302

[22] Filed: Feb. 25, 1985

[30] Foreign Application Priority Data

Feb. 27, 1984 [JP] Japan ..... 59-34381

[51] Int. Cl.[4] ..... B05C 11/00

[52] U.S. Cl. ..... 118/663; 118/657; 118/712

[58] Field of Search ..... 118/664, 657, 658, 663, 118/712

[56] References Cited

U.S. PATENT DOCUMENTS 4,082,445 4/1978 Steiner ..... 118/664 X 4,267,248 5/1981 Yamashita ..... 118/657

*Primary Examiner*—Bernard D. Pianalto

*Attorney, Agent, or Firm*—Wenderoth, Lind & Ponack

[57] ABSTRACT

A developing roll is composed of a hollow nonmagnetic sleeve and a permanent magnet disposed therein and having a plurality of poles, the sleeve and the permanent magnet being independently rotatable in the same direction. The hollow nonmagnetic sleeve is rotatable at a constant speed. The permanent magnet is rotatable at varying speeds dependent on a signal indicative of a count value from a printing density counter means for supplying a developer from a developer tank. The printing density counter means successively counts print data to be developed.

6 Claims, 6 Drawing Figures

DRY-TYPE DEVELOPING DEVICE FOR ELECTROPHOTOGRAPHY

BACKGROUND OF THE INVENTION

The present invention relates to a dry-type developing device for electrophotography, and more particularly to such a dry-type developing device for increasing or decreasing the amount of a developer supplied for developing a latent image dependent on the amount thereof consumed.

As disclosed in U.S. Pat. No. 4,267,248, a conventional dry-type developing device has a developing roll disposed in confronting relation to an electrostatic latent image carrier. The developing roll is composed of a hollow nonmagnetic sleeve and a permanent magnet, and is rotatable about its own axis. The permanent magnet is disposed in the hollow nonmagnetic sleeve and has alternately positioned S and N poles. A developer tank placed adjacent to the developing roll contains a developer therein. The developer tank has a cutout through which a portion of the developing roll enters into the developer tank to define a first opening (developer supply port) and a second opening (developer retrieval port) between the developing roll and the developer tank.

In operation, the developer in the tank is magnetically attracted to the peripheral surface of the sleeve and discharged from the tank through the first opening toward a developing region in response to rotation of the sleeve and the permanent magnet. In the developing region, part of the developer supplied from the tank is attached to an electrostatic latent image on the electrostatic latent image carrier for developing the latent image. The remaining developer which has not been attached to the electrostatic latent image is retrieved through the second opening into the developer tank.

The amount of the developer consumed in the developing region is largely dependent on the density of the latent image on the electrostatic latent image carrier, i.e., the printing density. More specifically, when an image of a high printing density is developed, the developer is temporarily consumed in a large amount, and thereafter an amount of the developer necessary for proper image developer cannot be supplied, resulting in a reduced printing density.

The conventional developing device of the type described therefore is required to have various means for keeping a constant printing density to ensure a good image quality. For example, U.S. Pat. No. 4,082,445 discloses a system for comparing, with a reference value, the difference between the intensity of light reflected from an undeveloped area on a photoconductive layer and the intensity of light reflected from a developed test image, and for supplying a developer to a developing device to increasing the printing density if the density of the test image is insufficient. Another means includes a density sensor for automatically detecting the density of characters printed on a sheet of print paper to control the amount of light radiated on an electrostatic latent image carrier or to control the voltage of a primary charging electrode for charging the electrostatic latent image carrier, dependent on the detected density level.

With the developing device incorporating the above means, however, the density of characters or images is detected while the print paper is running. The detected density if therefore unstable in level, and the printing density cannot be uniformized at a desired level. In addition, the developing device has been costly to manufacture.

SUMMARY OF THE INVENTION

Accordingly, it is an object of the present invention to provide an improved dry-type developing device.

Another object of the present invention is to provide a dry-type developing device capable of varying, dependent on the printing density, an amount of a supplied developer magnetically attracted to the peripheral surface of a developing roll for image development, to uniformize the printing density.

Still another object of the present invention is to provide a dry-type developing device suitable for printing images which consume a greater amount of a developer than characters.

Briefly summarized, the amount of a supplied developer attracted to the peripheral surface of a developing roll and transferred thereby is increased or decreased in relation to a printing density by means of a printing density counter circuit, for thereby uniformizing the printing density.

The printing density counter circuit counts the number of occurrences of energization of a light source which flashes according to print data to be printed, compares the count value with a predetermined reference value, and control the rpm of a magnet roll constituting a developing roll dependent on the difference between the count value and the reference value.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
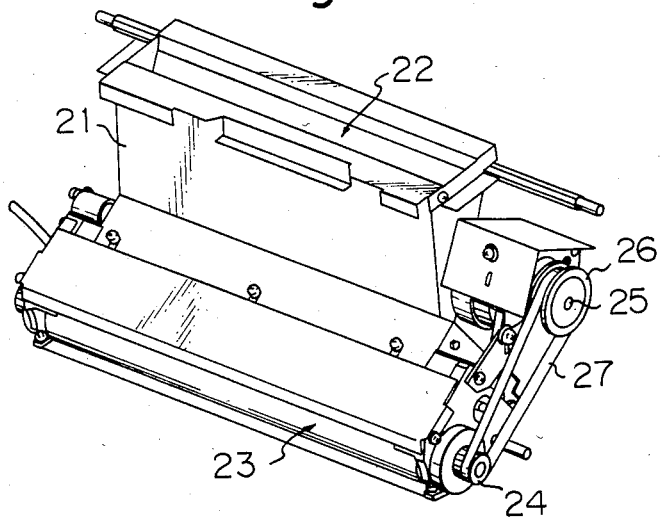
FIG. 1 is a perspective view of a dry-type developing device according to the present invention.

FIG. 1 show in perspective a dry-type developing device according to the present invention.

The dry-type developing device includes a developer tank 21 having a developer replenishing port 22 covered with a resilient body as of rubber for preventing a replenished developer from leaking out due to vibrations or the like. A hollow nonmagnetic sleeve 23 accommodates therein a permanent magnet to which there is directly coupled a shaft with a pulley 24 attached thereto. The pulley 24 is driven by a rubber belt 27 trained therearound and around a pulley 26 mounted on a motor shaft 25.

Figure 2:
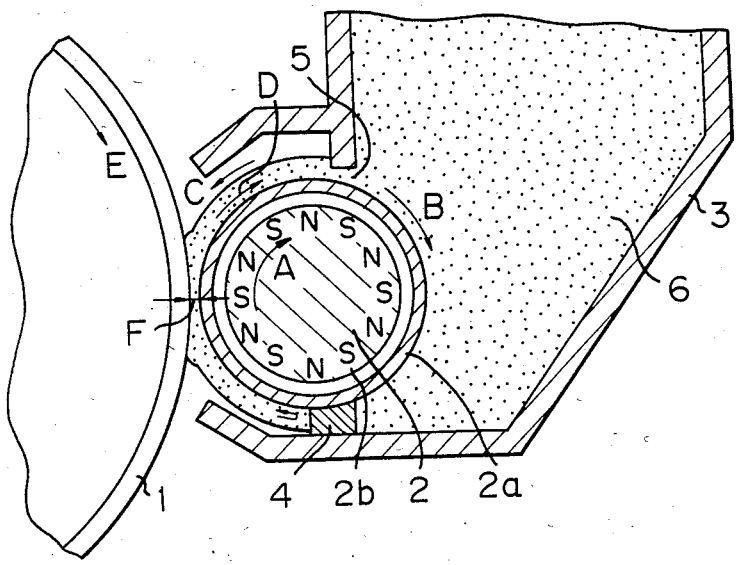
FIG. 2 is an enlarged fragmentary cross-sectional view of a developing roll and surrounding components in the dry-type developing device shown in FIG. 1.

FIG. 2 shows in fragmentary cross section major components shown in FIG. 1. A photosensitive drum 1 is employed as an electrostatic latent image carrier and is generally constructed of a photosensitive material such as selenium. The photosensitive drum 1 is rotatable at a constant speed in the direction of the arrow E. A developing roll 2 is disposed in confronting relation to the photosensitive drum 1 with a small gap F (normally in the range of from 0.3 to 0.6 mm) kept therebetween. The developing roll 2 is composed of a hollow nonmagnetic sleeve (hereinafter referred to as a "sleeve") *2a* and a multipolar permanent magnet *2b* disposed axially in the sleeve *2a* and having alternately disposed S and N poles arranged in a circumferential direction. The sleeve *2a* and the permanent magnet *2b* are rotatable relatively to each other. A developer tank 3 is positioned peripherally adjacent to the developing roll 2 and supports a stopper 4 positioned radially outwardly of the developing roll 2 and extending parallel to the axis of the developing roll 2. The stopper 4 is pressed against the developing roll 2 and made of a flexible material such as felt or polyurethane rubber. An opening 5 is defined radially outwardly of the developing roll 2 and positioned above the same, the opening 5 extending the full axial length of the developing roll 2 and having a small gap width. The developer tank 3 is supplied with a developer 6 through the developer replenishing port shown in FIG. 1. The developer 6 comprises a magnetic toner composed mainly of a magnetic material and plastics.

The developer 6 contained in the developer tank 3 can be discharged into a developing region only through the opening 5.

Operation of the developing device thus constructed will be described.

When an image developing cycle is started, a step motor (not shown) is energized to rotate the permanent magnet *2b* in the direction of the arrow A. At this time, a chain of the developer 6 is rotated along directional changes of flow of the magnetic flux in a direction opposite to the direction of rotation of the permanent magnet *2b*. Therefore, the developer 6 contained in the developer tank 3 is transferred through the opening 5 toward the stopper 4. With a slight delay from the rotation of the permanent magnet *2b*, the sleeve *2a* starts to be rotated by a motor (not shown) in the direction of the arrow B at a speed considerably lower than the speed of rotation of the permanent magnet *2b*. This delay time is determined by the rpm of the sleeve *2a* and the permanent magnet *2b*, and the number of poles and the flux density of the permanent magnet *2b*. If the rotation of the sleeve *2a* is extremely slow, then the developer 6 will tend to be collected in the vicinity of the stopper 4 and then fall off.

When the sleeve *2a* and the permanent magnet *2b* rotate at suitable speeds, a developer layer is formed on the peripheral surface of the sleeve *2a*. The thickness of the developer layer at this time is balanced at a constant thickness. The manner in which the balanced developer 6 is transferred will be described in detail. An inner layer portion of the developer layer formed on the peripheral surface of the sleeve *2a* is transferred primarily with the rotation of the sleeve *2a*, and an outer layer portion is transferred primarily with the rotation of the permanent magnet *2b*. The inner layer portion is moved in a manner to retrieve the developer 6 back into the developer tank 3 in the direction of the arrow D. The outer layer portion is transferred with the rotation of the permanent magnet *2b* while rolling on the peripheral surface of the sleeve *2a* in the direction of the arrow C. On the rotation of the permanent magnet *2b*, the outer layer portion of the developer 6 transferred in the direction of the arrow C reverses its direction of movement near the stopper 4 and blends into the inner layer portion. Thereafter, the developer 6 is transferred in the direction of the arrow D with the rotation of the sleeve *2a*, as described above. The above process balances the condition in which the developer 6 is transferred.

If the developer 6 is attached to the photosensitive drum 1 for image development and the developer 6 is consumed in the developing region extending from the opening 5 to the stopper 4, the developer 6 is continuously supplied from the developer tank 3. As the developer 6 is thus supplied, the thickness of the developer layer on the peripheral surface of the sleeve *2a* is balanced at a prescribed thickness determined by the rpm of the sleeve *2a*, the rpm and the number of poles of the permanent magnet *2b*, and the flux density.

Figure 3:
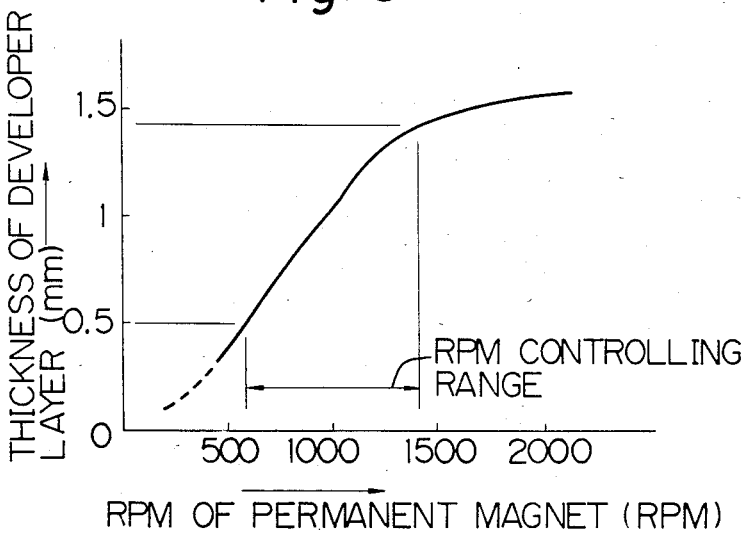
FIG 3 is a graph showing the manner in which the thickness of a developer layer formed on the developing roll is balanced.

FIG. 3 is a graph showing the manner in which the thickness of the developer layer is balanced. The sleeve *2a* is rotating at constant rpm, and the permanent magnet *2b* comprises a magnet roll having sixteen poles and a magnetic flux density of 600 gauss. FIG. 3 shows the relationship between the thickness of the developer layer which is balanced by variations in the rpm of the permanent magnet *2b* and the rpm of the permanent magnet *2b*. As can be understood from the illustrated relationship, the thickness of the developer layer can be adjusted in the range of from about 0.5 to 1.4 mm by controlling the rpm of the permanent magnet *2b* in the range of about 600 to 1,400. The thickness of the developer layer is an important condition to determine the printing density, and is normally selected to be about twice (about 0.5 to 1.4 mm) a gap F (normally 0.3 to 0.6 mm) between the photosensitive drum 1 and the sleeve *2a*.

Figure 4:
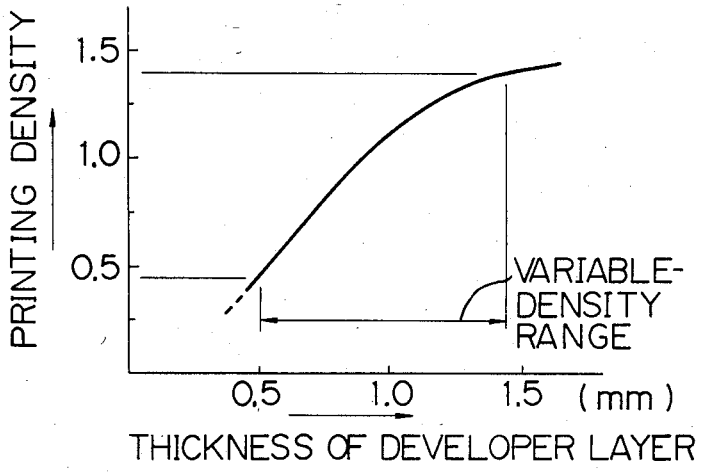
FIG. 4 is a graph showing the relationship between the thickness of the developer layer and a printing density in a developing region.

FIG. 4 shows the relationship between the thickness of the developer layer and the printing density in the developing region. As shown in FIG. 4, the printing density varies with the thickness of the developer layer within a variable-density range. It is possible to vary the printing density in the range of about 0.5 to 1.4 mm by changing the thickness of the developer layer in the range of about 0.5 to 1.4 mm within the variable-density range. For printing data having a standard density, its printing density is selected to be in the vicinity of 1.0.

The printing density of FIG. 4 was measured by a Sakura microdensitometer (manufactured by Konishiroku Photo Industry Co., Ltd.).

FIGS. 3 and 4 indicate that the printing density can easily be controlled by variably controlling the rpm of the permanent magnet *2b*.

Figure 5:
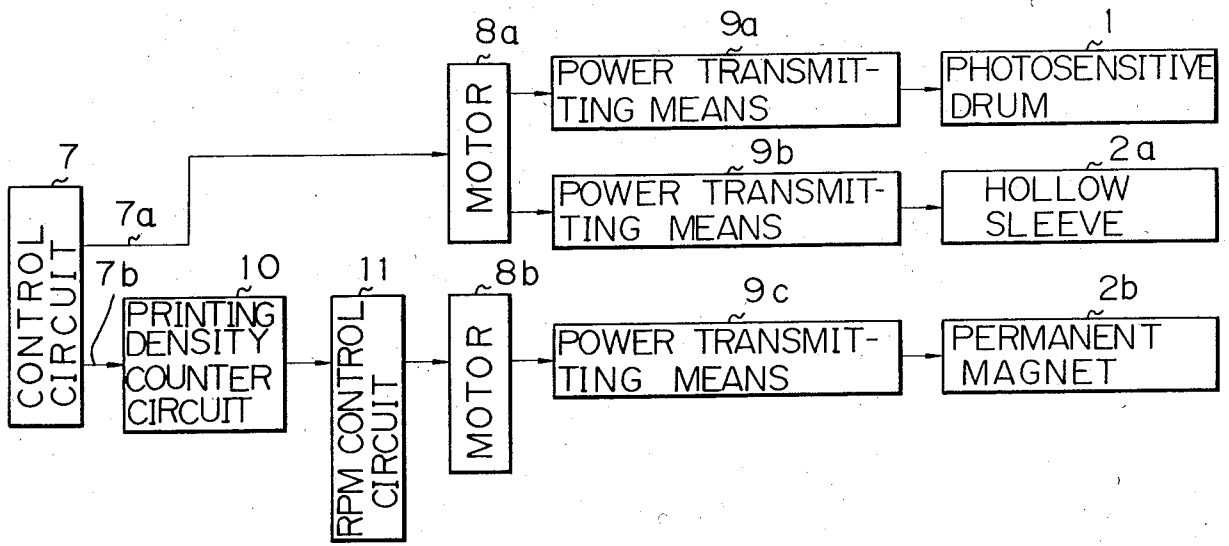
FIG. 5 is a block diagram of a driver for driving the dry-type developing device and a mechanism for controlling the amount of a developer supplied.

FIG. 5 shows a driver for driving the dry-type developing device and a mechanism for controlling the amount of a developer supplied.

In FIG. 5, when an image development cycle is started, signals *7a*, *7b* are produced by a control circuit 7 to energize motors *8a*, *8b*, respectively. The photosensitive drum 1, the sleeve *2a*, and the permanent magnet *2b* are rotated at respective speeds through power transmitting means *9a*, *9b*, *9c* such as gears or belts. After the components have started rotating, the developer is discharged through the opening 5 shown in FIG. 2 toward the stopper 4, and the thickness of the developer 6 on the peripheral surface of the sleeve 2*a* is balanced. Under this condition, a latent image formed on the photosensitive drum 1 is developed in frictional contact with the developer 6.

During the development process, the latent image on the photosensitive drum 1 is formed by a light source (not shown) such as a light-emitting diode (LED) or a laser, for example, serving as a radiating means for radiating print data to be printed. Normally, the latent image is formed on the photosensitive drum 1 at a density or printing density of 240 to 400 pixels per inch (about 2.54 cm). The amount of the developer consumed in the developing region in largely dependent on the latent image density or the printing density on the photosensitive drum 1.

The signal 7*b* from the control circuit 7 is supplied to a printing density counter circuit 100. The printing density counter circuit 10 is a circuit for counting the latent image density or the printing density per line or per a plurality of lines, and counts the number or occurrences of energization of the light source which flashes according to the print data to be printed. The count value is then compared with a predetermined reference value, and a signal representative of the difference is issued as a signal for controlling the rpm of the motor 8*b*. The signal is applied successively, continuously, or in a steplike manner, to an rpm control circuit 11. The rpm control circuit 11 is responsive to the control signal from the printing density counter circuit 10 for controlling the rpm of the motor 8*b*.

Figure 6:
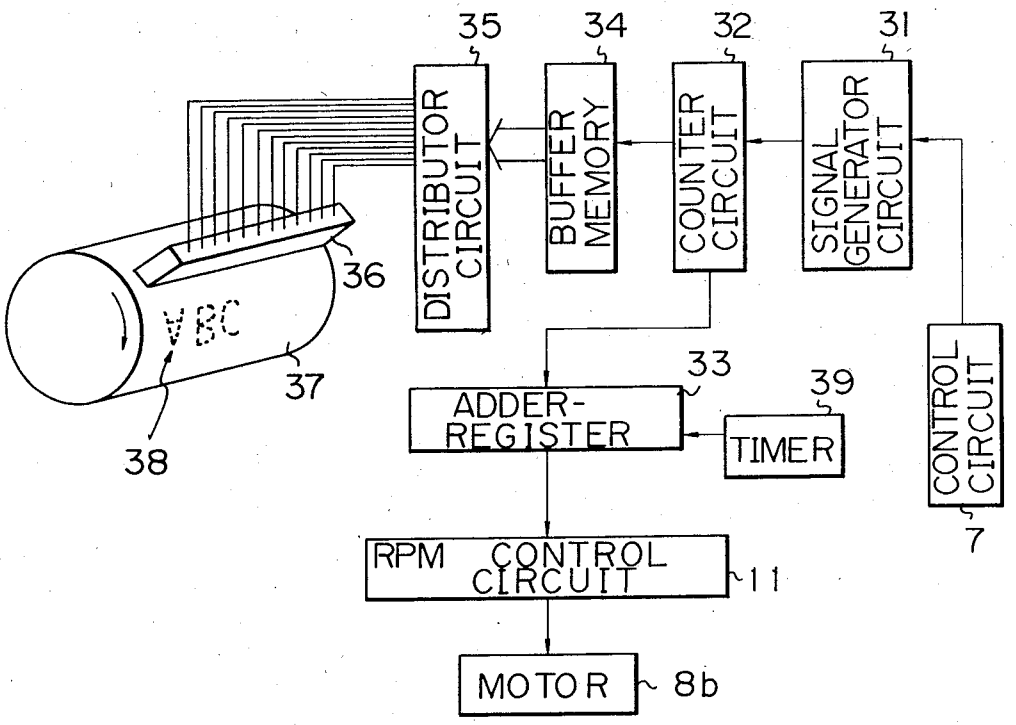
FIG. 6 is a block diagram of major components illustrated in FIG. 5.

FIG. 6 shows a system in which a light-emitting diode (LED) is employed as the radiating means for forming the latent image on the photosensitive drum 1. The relationship between the printing density counter circuit 10 and the rpm control circuit 11 will be described in detail.

In FIG. 6, when a print signal is generated from the control circuit 7, a signal generator circuit 31 generates a dot pattern signal per one dot line corresponding to the print signal. The signal per one dot line is then transferred to a counter circuit 32, which discriminates an energization signal from a de-energization signal in one dot line. Each time there is an energization signal, the counter circuit 32 issues a signal to an adder-register 33. The counter circuit 32 also transfers the signal received from the signal generator circuit 31 directly to a buffer memory 34.

The buffer memory 34 stores the one-dot-line signal therein, and then transfers the stored signal to a distributor circuit 35 in response to the reception of a write timing signal. The distributor circuit 35 serves to distribute signals to light-emitting diode elements, denoted 36, of the radiating means. The distributor circuit 35 energizes required light-emitting diode elements with the signal from the buffer memory 34 to form a latent image 38 on the photosensitive drum, denoted 37.

The adder-register 33 counts the energization signals from the counter circuit 32, that is, the number of occurrences of energization in one dot line, and transfers the count value to the rpm control circuit 11 per constant period of time. The rpm control circuit 11 compares the received count value with a predetermined reference value for controlling the rpm of the motor 8*b*.

The constant period of time, referred to above, should ideally be selected to be in the range of ½ to 10 times the time required to record light signals on the area of the photosensitive drum in the developing region. The constant period of time is set by a timer 39 which issues a signal to the adder-register 33 in each such constant period of time.

As described above with reference to FIG. 6, the printing density counter circuit 10 includes the counter circuit 32, the adder-register 33, and the timer 39.

The rpm control circuit 11 is therefore responsive to the signal from the printing density counter circuit 10 for controlling the rpm of the motor 8*b*.

Where the printing density is high, or an image is printed, the amount of the developer consumed is increased. Thus, the thickness of the developer layer is required to be increased, and the rotational speed of the motor 8*b* is increased dependent on the printing density. The speed of rotation of the permanent magnet 2*b* is then increased in the control range as shown in FIG. 3. When the speed of rotation of the permanent magnet 2*b* is thus increased, the thickness of the developer layer is increased dependent thereon as shown in FIG. 3, thus increasing the amount of the supplied developer. When the printing density is low, the speed of rotation of the permanent magnet 2*b* is reduced to decrease the amount of the supplied developer. Accordingly, the amount of the developer consumed varies dependent on the magnitude of the latent image density so that the amounts of the consumed and supplied developer will be balanced at all times. The printing density is therefore uniformized for obtaining good print quality.

As described above with reference to the illustrated embodiment, the present invention has the following advantages:

The amount of the developer magnetically attracted to the peripheral surface of the developing roll and consumed for image development tends to vary dependent on the printing density. However, the amount of the consumed developer is prevented from varying by increasing the decreasing the amount of the developer supplied dependent on the printing density.

The amount of the supplied developer can easily be controlled by the rpm of the permanent magnet controlled based on the data of the printing density successively counted by the printing density counter circuit.

With the simple arrangement, the developer can be supplied dependent on the printing density to produce a high printed image quality according to the print data to be developed. The present invention can provide a dry-type developing device suitable for the printing of images which consume a large amount of developer.

Although a certain preferred embodiment had been shown and described, it should be understood that many changes and modifications may be made therein without departing from the scope of the appended claims.

What is claimed is:

1. A dry-type developing device for electrophotography, comprising:

an electrostatic latent image carrier having means for receiving print data to form an electrostatic latent image thereon for being developed thereon;

a developer tank for holding a developer therein;

a developer roll rotatably disposed adjacent to said electrostatic latent image carrier so as to support developer supplied from said developer tank in frictional contact with said electrostatic latent image carrier to develope the latent image formed on said electrostatic latent image carrier;

means for supplying developer from said developer tank to said developer roll;

means for transmitting print data onto said electrostatic latent image carrier;

means for counting the printing density of the print data being transmitted by said transmitting means and providing a signal indicative of the printing density counted by said counting means; and means, responsive to said signal, for controlling the rotational speed of said developing roll as a function of the printing density counted by said counting means so as to increase or decrease the amount of developer being supplied to said from said developer tank to said electrostatic latent image carrier dependent on the amount of developer being consumed to develope the latent image.

2. A device as in claim 1, wherein said developing roll comprises a hollow nonmagnetic sleeve and a permanent magnet disposed in said hollow nonmagnetic sleeve and having a plurality of poles, said hollow nonmagnetic sleeve being rotatable at a constant speed in a predetermined rotation direction, said permanent magnet being rotatable at variable speeds in said predetermined rotational direction, said controlling means comprising means for controlling the rotational speed of said permanent magnet.

3. A device as in claim 2, wherein said supplying means includes means, upstream of said carrier, for guiding developer from said developer tank onto the peripheral surface of said sleeve, said developing roll carrying, in response to rotation of said permanent magnet, a primarily outer stratum continuum of the developer circumferentially along and radially space from said peripheral surface, from said guiding means to said electrostatic latent image carrier, such that a portion of said continuum is carried downstream past said electrostatic latent image carrier circumferentially along said peripheral surface;

said supplying means further including stopper means, downstream of said electrostatic latent image carrier, for blocking further downstream movement of said portion of said continuum, whereby developer at said blocking means is carried primarily radially inside the outer stratum in an inner stratum radially inside said outer stratum by frictional contact with said sleeve past said electrostatic latent image carrier toward said developer tank.

4. A device as in claim 2, wherein the said controlling means comprises means for comparing the value of the print density counted by said counting means to a reference value and controlling the rotational speed of said developing roll on the basis of the difference between said the value of the print density and the reference value.

5. A device as in claim 1 wherein said transmitting means comprises means for energizing a light source adjacent said electrostatic latent image carrier so as to produce flashes of light, said counting means comprising means for counting energizing signals which energize the light source such that the number of energizing signals counted represents the number of flashes to be produced by said energizing means.

6. A device as in claim 1, wherein said counting means comprises means for counting the print density per predetermined number of lines.

* * * * *